US007244187B2

(12) United States Patent
Brooks

(10) Patent No.: US 7,244,187 B2
(45) Date of Patent: Jul. 17, 2007

(54) GOLF PUTTING TRAINING DEVICE

(76) Inventor: Roger John Brooks, 7, Airedale, Galgate, Lancaster LA2 0RR (GB)

( * ) Notice: Subject to any disclaimer, the term of this patent is extended or adjusted under 35 U.S.C. 154(b) by 51 days.

(21) Appl. No.: 10/524,297

(22) PCT Filed: Aug. 27, 2003

(86) PCT No.: PCT/GB03/03705

§ 371 (c)(1),
(2), (4) Date: Aug. 23, 2005

(87) PCT Pub. No.: WO2004/020053

PCT Pub. Date: Mar. 11, 2004

(65) Prior Publication Data

US 2006/0035716 A1 Feb. 16, 2006

(30) Foreign Application Priority Data

Aug. 28, 2002 (GB) ..... 0220052.5

(51) Int. Cl.
*A63B 69/36* (2006.01)

(52) U.S. Cl. ..... 473/227; 473/226

(58) Field of Classification Search ..... 473/226, 473/227, 231

See application file for complete search history.

(56) References Cited

U.S. PATENT DOCUMENTS 3,918,721 A * 11/1975 Trask, Jr. ..... 473/223
4,145,054 A * 3/1979 Stewart ..... 473/227
4,170,356 A * 10/1979 Banks ..... 473/227
5,174,575 A * 12/1992 Leith et al. ..... 473/213
5,203,568 A * 4/1993 Vasquez ..... 473/212
5,465,971 A * 11/1995 Tischler ..... 473/227
5,520,392 A * 5/1996 Foresi et al. ..... 473/227
5,904,624 A * 5/1999 Martinez ..... 473/212
6,004,221 A 12/1999 Thornhill
6,471,598 B2 * 10/2002 Takase ..... 473/212
6,491,591 B1 * 12/2002 Schuster ..... 473/212
6,656,056 B1 * 12/2003 Leonard ..... 473/227
7,090,588 B2 * 8/2006 Bamber ..... 473/226
2006/0035716 A1 * 2/2006 Brooks ..... 473/227

FOREIGN PATENT DOCUMENTS

WO WO 2004/020053 A1 11/2004

* cited by examiner

*Primary Examiner*—Raleigh W. Chiu
(74) *Attorney, Agent, or Firm*—Egbert Law Offices

(57) ABSTRACT

Apparatus for use by a golfer with a putter, and the method of its use, includes a member, removably and firmly attachable at/near its lower end to the shaft of the putter, and extending upwardly from the point of attachment and having an upper end, and the upper end of the member being adapted to contact an appropriate part of the anatomy of the golfer. When a golfer executes a correct putting stroke, the upper end of the member remains in contact with that part of the golfer's anatomy throughout the whole of the swing but, if the stroke is not correct, the upper end of the member either loses contact, or moves across, or presses harder into the anatomy of the golfer. A contact device in the form of a resilient ball or the like is fixed to the or each upper end. These are capable of giving an audible or visual warning of loss of contact with the golfer's body or of increased contact pressure with the body.

7 Claims, 8 Drawing Sheets

GOLF PUTTING TRAINING DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This specification relates to apparatus for improving golf putting techniques and to the method of using it.

BACKGROUND OF THE INVENTION

Golf is an extremely popular game, both as a form of recreation and as a competitive sport.

As a recreation, it plays an important part in providing players with physical exercise, e.g. walking, bending, keeping the body supple and, of course, exercising the heart, lungs, etc., as well as giving them fresh air in an outdoor environment. Thus for many, golf is an essential part in keeping themselves physically fit and healthy. In addition to being a pure recreation, many golfers naturally wish to improve their technique and their handicaps, so that they can take part in competitions at their local club, with other nearby clubs or, perhaps, even play professionally.

Golf, perhaps more than any other sport, is one where technique is all-important and where a slight improvement can bring disproportionate rewards. Learning the correct technique is difficult and thus there is a need for equipment, and methods of using it, which golfers can use to help them improve.

Golf consists of three stages, i.e. driving, playing on and off the fairway, e.g. with woods, irons, wedges, etc., and putting. Technique is important at each of these stages but possibly most critical at the putting stage on the green where all those playing congregate for the climax of the hole. It is here, under the critical gaze of one's opponents, that nerves can affect a golfer's play and where adherence to correct technique can be most critical.

Most golf coaches advocate a 'pendulum stroke' for putting, in which the putter is swung by rotating the upper body and shoulders, with the wrists and arms remaining passive. Training devices for putting, based on this method, include U.S. Pat. No. 5,520,392, where a member attached to the putter extends under the armpit, and U.S. Pat. No. 5,156,401, which teaches a frame under both armpits. In both these cases, the training device acts to restrict the movement of the golfer to that required, i.e. they act as a form of straightjacket physically restraining movement. In contrast, a much more preferable form of training teaches the golfer to control muscle movements voluntarily. Thus, neither of these training devices adequately helps the golfer to gain the necessary degree of voluntary muscle control to putt correctly.

A training device for the golf swing is U.S. Pat. No. 4,145,054, which teaches a rod, attached to the golf club, that contacts the forearm in an incorrect swing but does not touch it if the swing is correct. The proper technique for the golf swing is quite different to that for putting and so this method would not be suitable for putting practice. Furthermore, there are types of incorrect swing in which the rod will move away from the arm, and these will not be indicated by this particular device. U.S. Pat. No. 5,531,446 teaches a putting aid with an extension of the putter shaft, which contacts the stomach area of the golfer's body. This is not the best part of the body to monitor for incorrect movements during a practice swing.

The best parts of the body to monitor are the arms and shoulders, as these are the key members connecting the torso to the putter. Monitoring the movement of the arms and shoulders relative to that of the putter and controlling these movements voluntarily is the best way to perfect a putting stroke. None of the prior art achieves this.

BRIEF SUMMARY OF THE INVENTION

According to a first aspect of the invention, there is provided a training device for use with a putter by a golfer for improving the technique of putting, the putter having a shaft and a head fixed at the lower end of the shaft, the device comprising: an elongate member, having a first end and at least one second end, the first end being provided with a mounting adapted to be detachably mounted on the shaft such that the elongate member extends upwardly away from the shaft at an angle set by an angularly-adjustable part of the mounting; and contact means at the second end of the elongate member and adapted to contact an appropriate part of the anatomy of the golfer; wherein the elongate member and/or said mounting are adjustable so that the elongate member extends for a predetermined distance and at a predetermined angle so that the contact means contacts an appropriate part of the anatomy of the golfer in such a way that, when the golfer executes a correct putting stroke, the contact means remains in contact with that part of the golfer's anatomy throughout the whole of the swing but, if the stroke is not correct, the contact means either loses contact, or moves across, or presses harder into the anatomy of the golfer.

In one form of the invention, the contact means is provided by the second end of the elongate member. However, in a preferred embodiment the contact means is in the form of a body attached to the second end of the elongate member. In this case, the body is preferably a ball of resilient material such as foam rubber.

The mounting, which detachably mounts the elongate member to the putter shaft, may comprise a clamp with suitable hand-operated means such as a thumbscrew. The mounting may also incorporate a ball joint, or another kind of joint with the same number of degrees of freedom.

Preferably, the mounting carries a scale on its angularly-adjustable part so that the angle of attachment of the elongate member to the putter shaft can be noted. In this way it is possible to record the angle and reset the device to the same angle at a later time.

The length of the elongate member is preferably, but not necessarily, made adjustable and conveniently this is achieved by means of a telescopic portion thereof. In this case, the telescopic portion is preferably marked with a scale so that the length (degree of extension) of the elongate member can be noted. However, a set of connectable tubes each of fixed length could be used instead, in order to provide a variety of overall lengths of the elongate member.

In one form of the device, the elongate member is a rod or tube having a single second end (free end).

In another form of the device, the elongate member is of a construction such as a Y-shape, cross-shape, T-shape or L-shape providing more than one second end, each of which has its own contact means. In this way, more than one part of the golfer's body can be contacted simultaneously. When more than one second end is provided, adjustable means are preferably incorporated for adjusting the position of each second end relative to the others, thus allowing freedom of placement of the respective contact means on the golfer's body. An L-shape, cross shape or T-shape construction can conveniently be provided by attaching (e.g. clipping) a second rod or tube part way along the elongate member.

The body, which provides the or each contact means in the preferred embodiment, is preferably removable and/or interchangeable. In this way it is possible to install bodies having different sizes and/or properties.

The body can be adapted to give a visual and/or audible indication when contact with the golfer's body is lost. In addition, an indication of excessive contact pressure may also be given.

According to a second aspect of the present invention, there is provided an assembly comprising a putter and a training device according to the first aspect.

According to a third aspect of the invention, there is provided a method of practicing a putting stroke using a training device according to the first aspect of the invention.

In a preferred exemplary application of the invention, the training device is clamped onto the shaft of the putter using a clamp incorporating a ball joint or equivalent. The clamp and upwardly extending member are attached in such a manner that they extend away from the shaft of the putter and do not interfere with the golfer's (user's) movement. Ideally, the upwardly extending member is telescopic and terminates in an item or contact means at its upper end, which contacts the golfer's body (through a contact region) in a gentle way, e.g. the item may be a sphere.

Using the ball joint and telescopic extension, the training device is adjusted so that the sphere just touches an appropriate part (e.g. arm, shoulder or chest) of the golfer's body, namely a body part which it is important to control when putting. He/she may then practice putting strokes and, if the technique is correct, the sphere will remain in contact with the golfer's body throughout the whole of the stroke, including follow through. If the technique is not correct, contact will be either lost during all, or part, of the stroke, or the sphere will press harder onto the golfer's body or the sphere will slide over the golfer's body.

The apparatus of the invention allows training in a series of stages, directed to different points on the body and/or different levels of precision of technique.

When the golfer has mastered one aspect of the technique, the ball joint and telescopic member may be re-positioned so that the sphere touches another part of the body and this aspect of the technique can be practiced. The process can be repeated as often as necessary until the golfer has obtained the required technical level AND/OR until the golfer can correctly control movement of every important body part, especially the hands, arms, shoulders and upper chest. The golfer can return to a previous stage of training, if a subsequent stage results in a problem with the previous stage (s). Ideally, scales or graduations are provided on the ball joint and telescopic extension so that settings optimized on one training session can be reset for a subsequent one (s).

Other preferred variations of the apparatus of the invention include the upwardly extending member or the contact means being adapted so that the contact regions contact more than one part of the golfer's body at the same time. This will be advantageous when the golfer is trying to master the finer points of the technique. As some golfers may not have sufficiently sensitive skin to detect loss of bodily contact with the sphere, electronic means, in the sphere, may be used to give an audible or visual indication of loss of contact or excessive pressure of contact. This may be especially advantageous on occasions when the golfer is wearing thick clothing.

BRIEF DESCRIPTION OF THE SEVERAL VIEWS OF THE DRAWINGS

For a clearer understanding of the invention and to show how it may be put into effect, reference will now be made, by way of example only, to the accompanying drawings.

FIG. 9 is a front elevation view of the golfer, shown in FIG. 8, during the follow through.

DETAILED DESCRIPTION OF THE INVENTION

Figure 1:
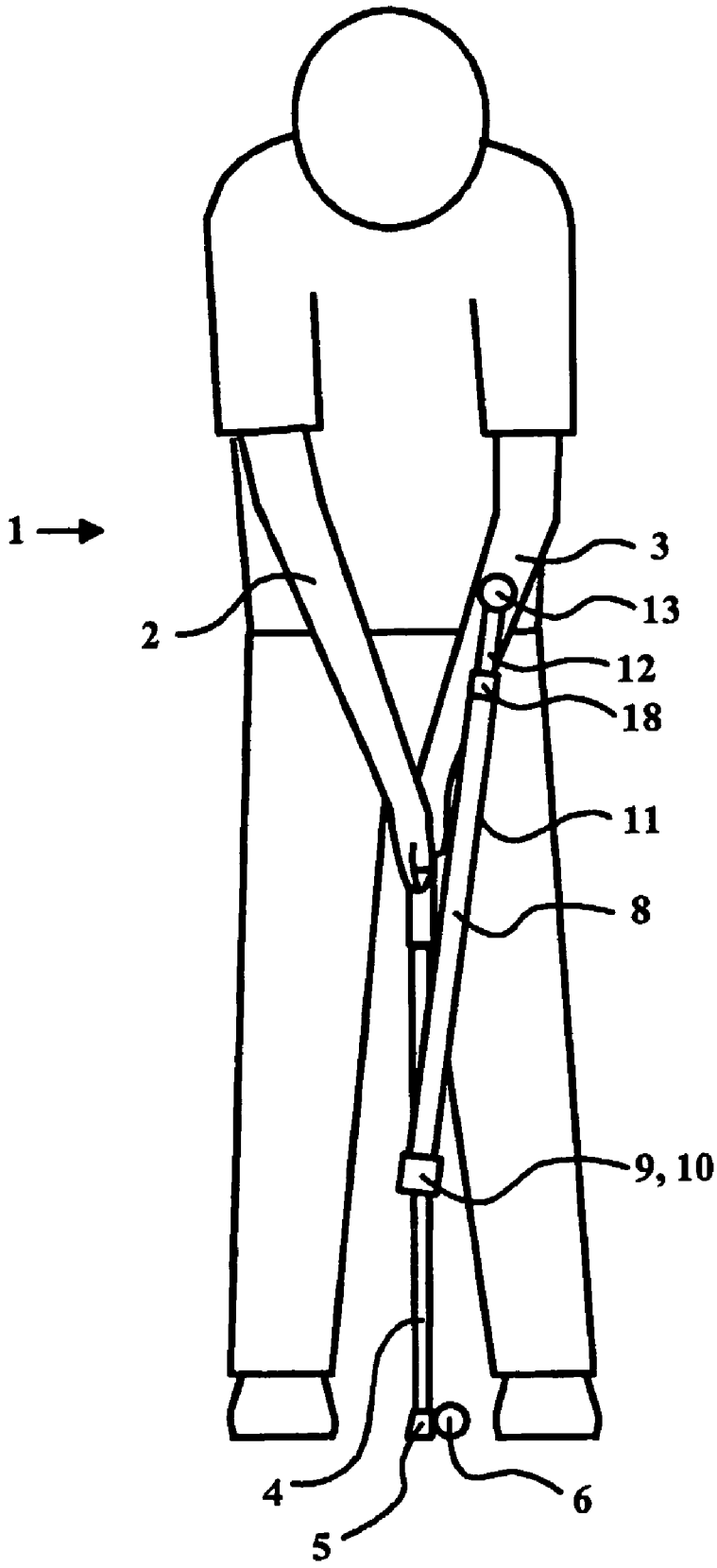
FIG. 1 is a front elevation view of a golfer using an embodiment of the invention with the apparatus touching the front of the left forearm.

Referring to FIG. 1, a golfer 1 is shown in the position for putting, holding a putter 4 in his hands. The head 5 of putter 4 is shown adjacent to a golf ball 6. Attached to the shaft of putter 4 is a training device 8 embodying the invention, having a clamp 9, thus removably attaching the training device 8 to the shaft 4 of the putter. The training device is preferably attached at or near the lower end of the putter to improve the sensitivity of the device to movements of the golfer's body. Training device 8 includes an upwardly extending hollow cylindrical member 11 inside which is a piston-type member 12 which may be withdrawn from cylinder 11 to an appropriate length. A locking means 18 is provided to lock piston 12 within cylinder 11 to provide sufficient friction to retain the pair of telescopic members 11 and 12 at their preset position. The upper end of piston member 12 terminates in an item (contact means) 13, shown for convenience, as a sphere, and preferably made of a resilient material, for example a foam-rubber ball into which the free end of piston member 12 is inserted.

Figure 2:
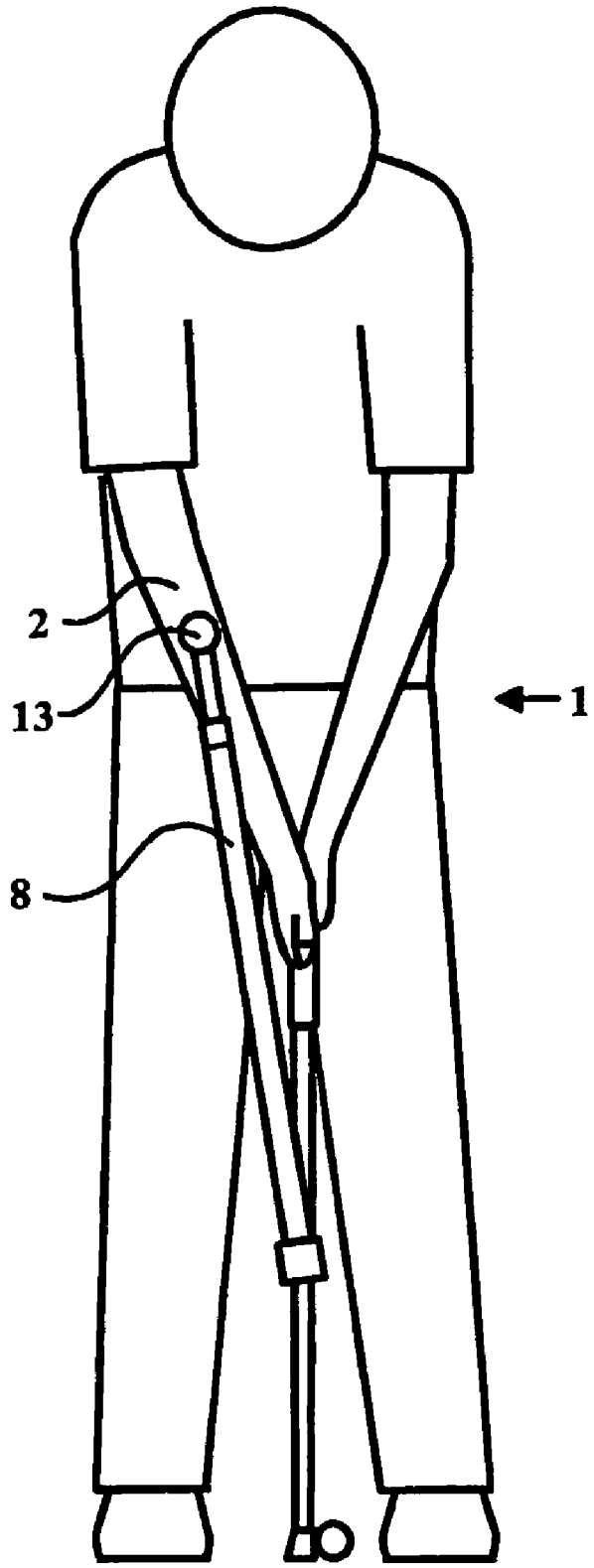
FIG. 2 is a front elevation view, similar to FIG. 1, with the apparatus touching the front of the right forearm.
Figure 7:
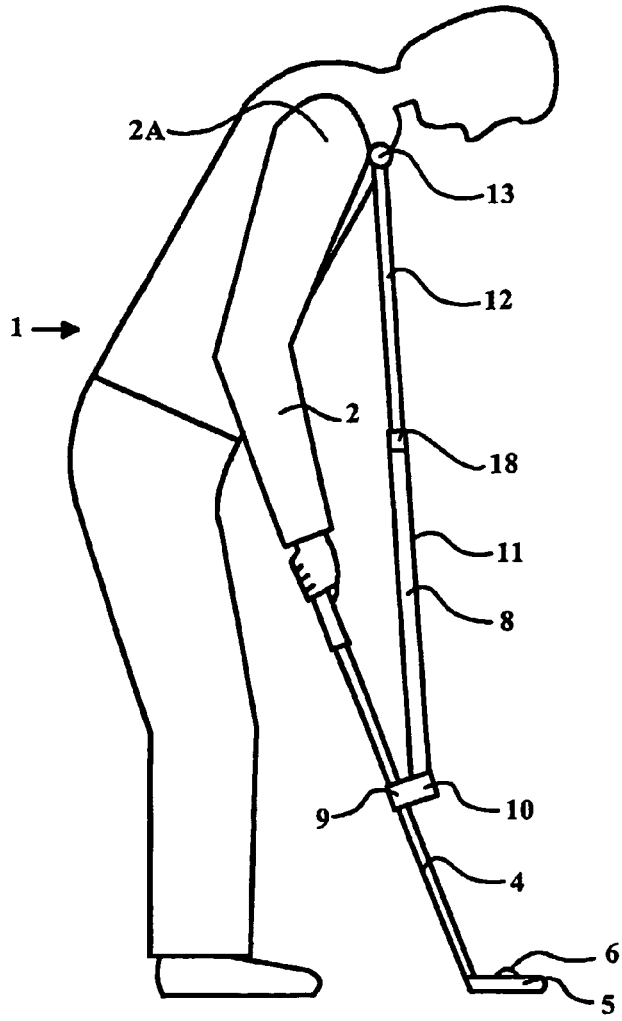
FIG. 7 is a side elevation view of a golfer using the apparatus with it touching the front of the right shoulder.

The attachment clamp 9 extends forwardly from shaft 4 (FIG. 7) and includes a mounting 10 formed of a ball joint or equivalent arrangement, which may be locked by a means such as a screw 7 (FIG. 1). As frequent major and minor positional adjustments to the angle of training device 8 have to be made to position correctly sphere 13 against an appropriate part of the golfer's anatomy, easily operated hand screws 7 and 14 are preferred for locking clamp 9 and mounting 10 in position. Similar adjustments to the length of telescopic member 11, 12 will also have to be made via locking means 18. The purpose of this arrangement is so that members 11 and 12 are clear of the golfer's hands and allows sphere 13 to be adjusted so as to just contact a particular part of the golfer's body. In FIG. 1 it is the front (top) of left forearm 3. In FIG. 2 it is the front of right forearm 2 and in FIG. 3 it is the side of left forearm 3. In FIG. 4, it is the front of left shoulder 3A, and in FIG. 5 it is the front of right shoulder 2A.

Figure 6:
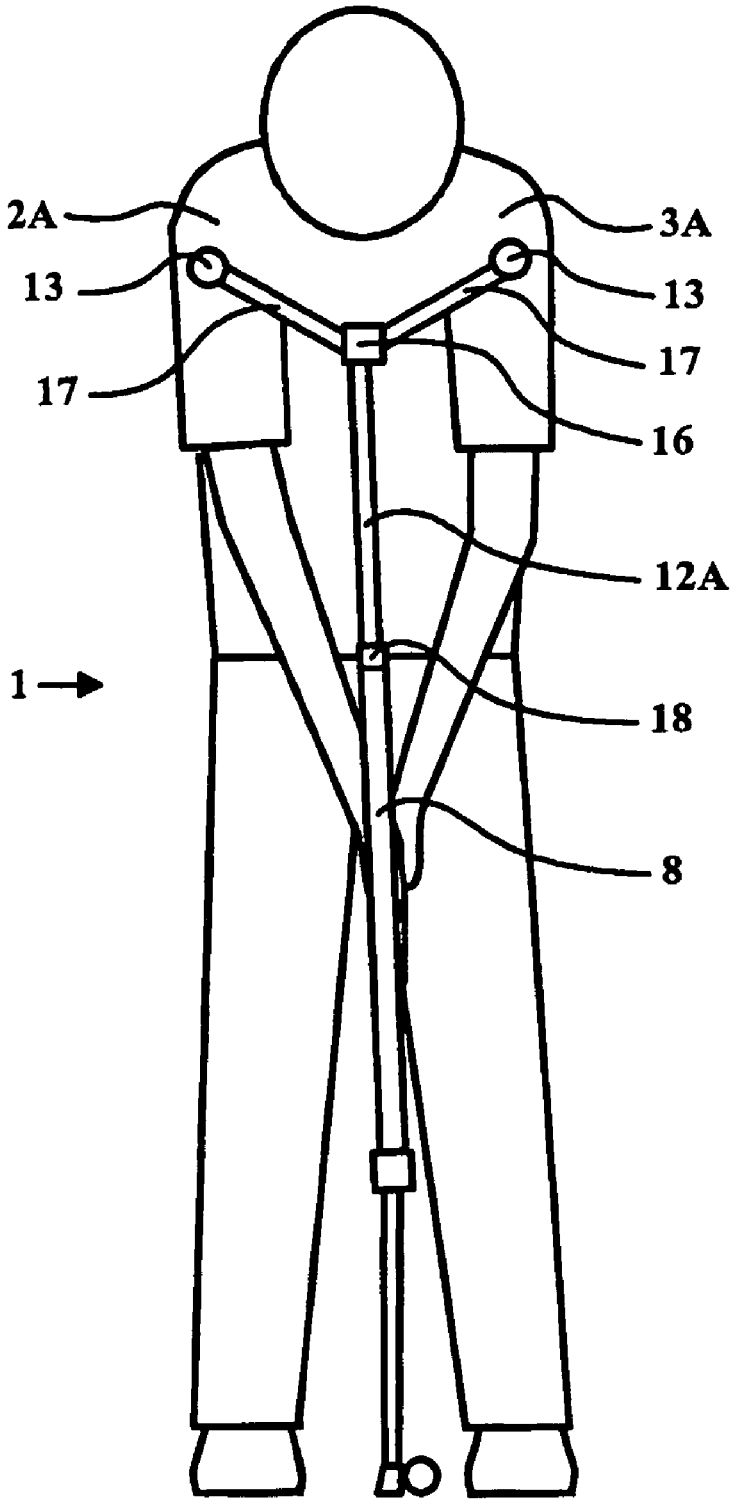
FIG. 6 is a front elevation view, similar to FIG. 1, with the apparatus now having two contact regions touching the fronts of both the left and right shoulders.

In FIG. 6, piston member 12 is replaced by another member 12A, terminating in connection 16 with side arms 17, each terminating in a contact sphere 13. Alternatively, sphere 13 may be removed from the end of member 12 and replaced by a connection (e.g. T-joint) 16, carrying side arms 17. Here, the two spheres 13 contact the fronts of both shoulders 2A and 3A. Locking device 18 is preferably of the type used on trekking poles and can be released sufficiently to allow a first piston member 12 to be removed and replaced by a second one 12A.

Alternatively, a second rod (not shown) may be clipped or otherwise mounted at some point along the member 12. This second rod may be straight or may be shaped so as to avoid the golfer's chest. In this case, there is no need to detach the sphere 13 from the end of member 12. The second rod is simply attached part way along member 12. Preferably, the mounting attaching the second rod to member 12 is situated in the middle of the second rod so that member 12 and the second rod form a cross or a T-shape. The device is adjusted using mounting 10 so that the side of the rod contacts the fronts of both arms or both shoulders simultaneously. Alternatively, the rod may be provided with one or more spheres or other contact means to provide contact points on the golfer's body. Shaping of the second rod (such as bowing outwards away from the golfer's chest) is preferable when the shoulders are to be contacted. Preferably, the rod would be comprised of foam rubber, or would have foam rubber, or other such material as an outer casing.

The ideal technique for putting is for the shoulders to rotate around the spine caused partly by a rotation of the upper chest (sternum). Anatomical movements of other parts of the body should be kept to a minimum. This is often referred to as a "pendulum stroke". Successful putting requires great accuracy and so reducing the anatomical movements should make the putting stroke more precise and consistent particularly when under pressure.

In particular, in the ideal technique, the hands and arms should not move relative to the positions of the shoulders during the entire putting stroke (i.e. backswing, downswing and follow through). For example, there should be no bending or straightening of the arms and there should be no cocking, rotating or hinging of the wrists. The putter, hands, arms and shoulders should remain in a fixed position with respect to each other throughout the entire stroke.

Training device 8 provides a physical connection between putter 4 and one or more points on the hands, arms, shoulders or upper chest. Any change in the contact between sphere 13 of training device 8 and the golfer during the putting stroke (either a loss of contact, an increase in contact pressure or a change in contact position) indicates a deviation from the ideal technique. Training device 8 will identify incorrect movements of a small magnitude, which is important because of the high level of precision required in putting.

The player can practice putting strokes (either hitting a ball or without hitting a ball) (FIGS. 8 and 9) attempting to minimize the magnitude of any movement of the contact point on training device 8 relative to the initial contact point on the player's body. This helps the player to learn good technique, which they can continue to employ when training device 8 is removed. (The player would not be allowed to use it in competitive play.)

The path of the putter in the horizontal plane may be a straight line along the line of the putt or may be an arc on the backswing, downswing or follow through depending on the precise movements of the upper chest and shoulders. The ideal technique as described will apply in each case and so training device 8 can be used to improve technique whichever putter path the player prefers.

It is a feature of the invention that the action of spheres 13 is double-acting, i.e. if the error in the swing is in a first direction, sphere 13 will lose contact with the body of the golfer and if the error is in a second, opposite direction, sphere 13 will press harder into the flesh. Other errors at right angles to either the first or the second direction, will cause sphere 13 to move across the surface of the golfer's body. This is ideal for a person with sensitive skin, who can detect the relative movement, if any, between his/her body and sphere 13. However, not everyone has the required degree of sensitivity. In such cases, electronic or mechanical means may be provided to increase the effectiveness of the training device.

In a first example, an on/off microswitch (not shown) could be incorporated into sphere 13 and training device 8 adjusted so that the pressure of the contact between sphere 13 and the golfer's body closed the microswitch. Provided sphere 13 maintains contact with the golfer's body, the microswitch would remain closed. If, however, an error in the swing caused sphere 13 to lose contact with the golfer's body, the microswitch would open and cause an alarm to be activated. The alarm could be either visual, e.g. a flashing light, or audible, e.g. a buzzer.

An alternative to the microswitch could be a dielectric switch (not shown), such as used on microwave cookers and hand dryers, etc. Here, the switch could be closed by the proximity of the golfer's skin and would open when sphere 13 moved away from the golfer's body. It is known that the sensitivity of such switches can be pre-set. An adjustment could be provided on sphere 13, e.g. to compensate for the golfer's clothing, i.e. a thin shirt or a thick fleece.

A variation of this system could be a double-acting alarm. In this case, the sensitivity of the dielectric switch could be adjusted so that it would give a first signal when sphere 13 is pressed hard against the golfer's body, no signal when it was just in contact with the body and a second signal, when contact was broken. In this case, the indications could be, for example, either red and green flashing lights, or high and low pitch buzzers.

Another variation is a purely mechanical switch response, for example, to deformation or relaxation of a resilient sphere 13 to click from one position to another, causing a sound to be made either directly or indirectly via a bell, rattle or the like.

Spheres 13 could be interchangeable, e.g. one with no electronic indication, another with uni-directional electronic indication and a third with a bi-directional indication. On sphere 13, there could be on/off switches to save the battery when training device 8 was not in use and also a delay facility to allow the golfer to set the electronics before taking up his putting stance. Such a delay would give him/her, say 10 seconds, after switching the device on before it became operational so that he/she could adopt the correct stance before it started flashing or buzzing. A simple friction slip-on/slip-off means of attachment of spheres 13 on shaft 12 would be ideal.

Thus, the training device is suitable for use in a group setting or for individual practice. A simple sphere 13 (i.e. one without an alarm) could be used for beginners, when they are likely to be making many errors, to allow them to gain the basic principles. As the technique improves sphere 13 could be replaced by one equipped with an alarm to allow the golfer to make further, smaller improvements. Initially, this might require only an uni-directional sensor but, as the technique gets even better, bi-directional sensors could be used. As people are sometimes sensitive to other people knowing that they are making errors, the flashing light might appeal more to shy golfers, while others might be quite happy to use audible indications.

Figure 3:
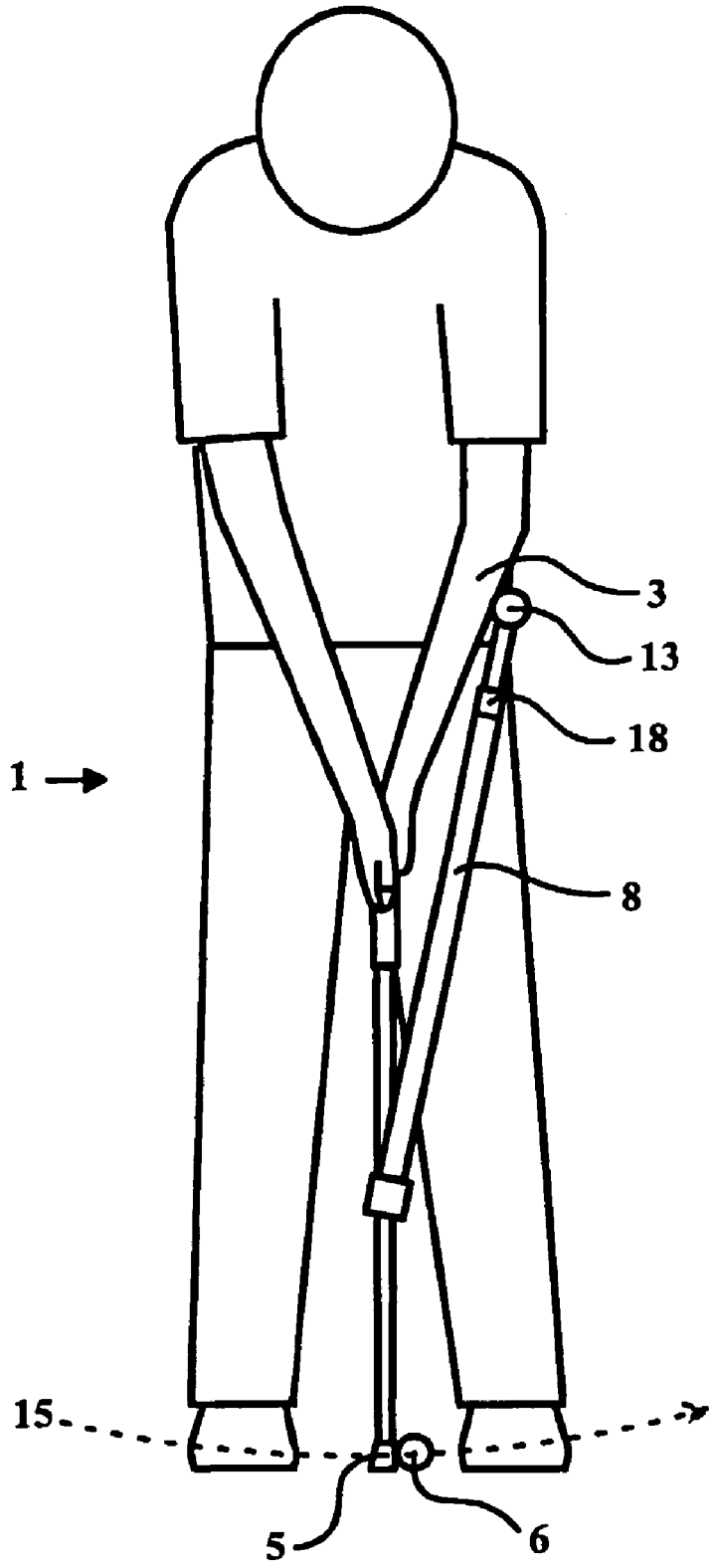
FIG. 3 is a front elevation view, similar to FIG. 1, with the apparatus touching the side of the left forearm.
Figure 4:
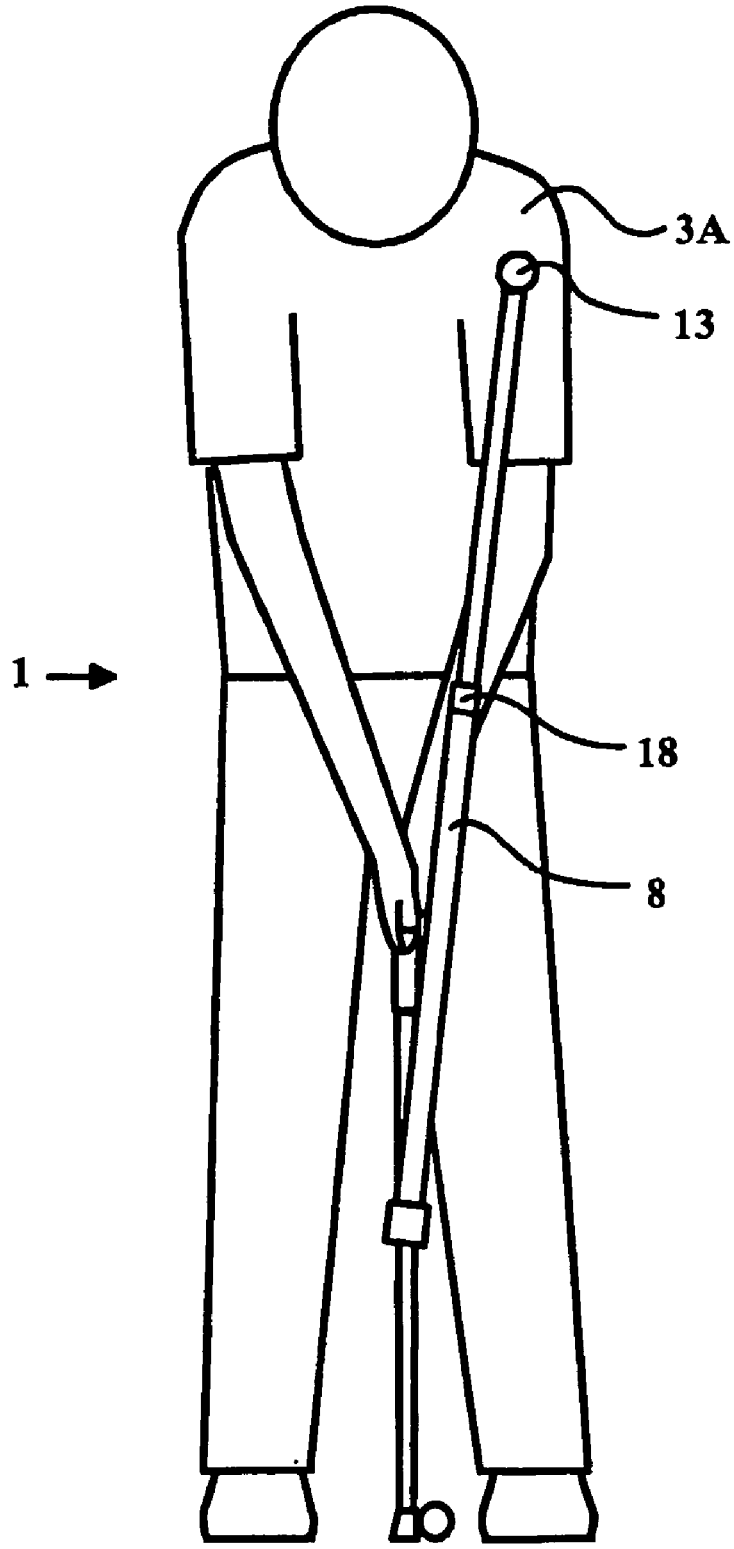
FIG. 4 is a front elevation view, similar to FIG. 1, with the apparatus touching the front of the left shoulder.
Figure 5:
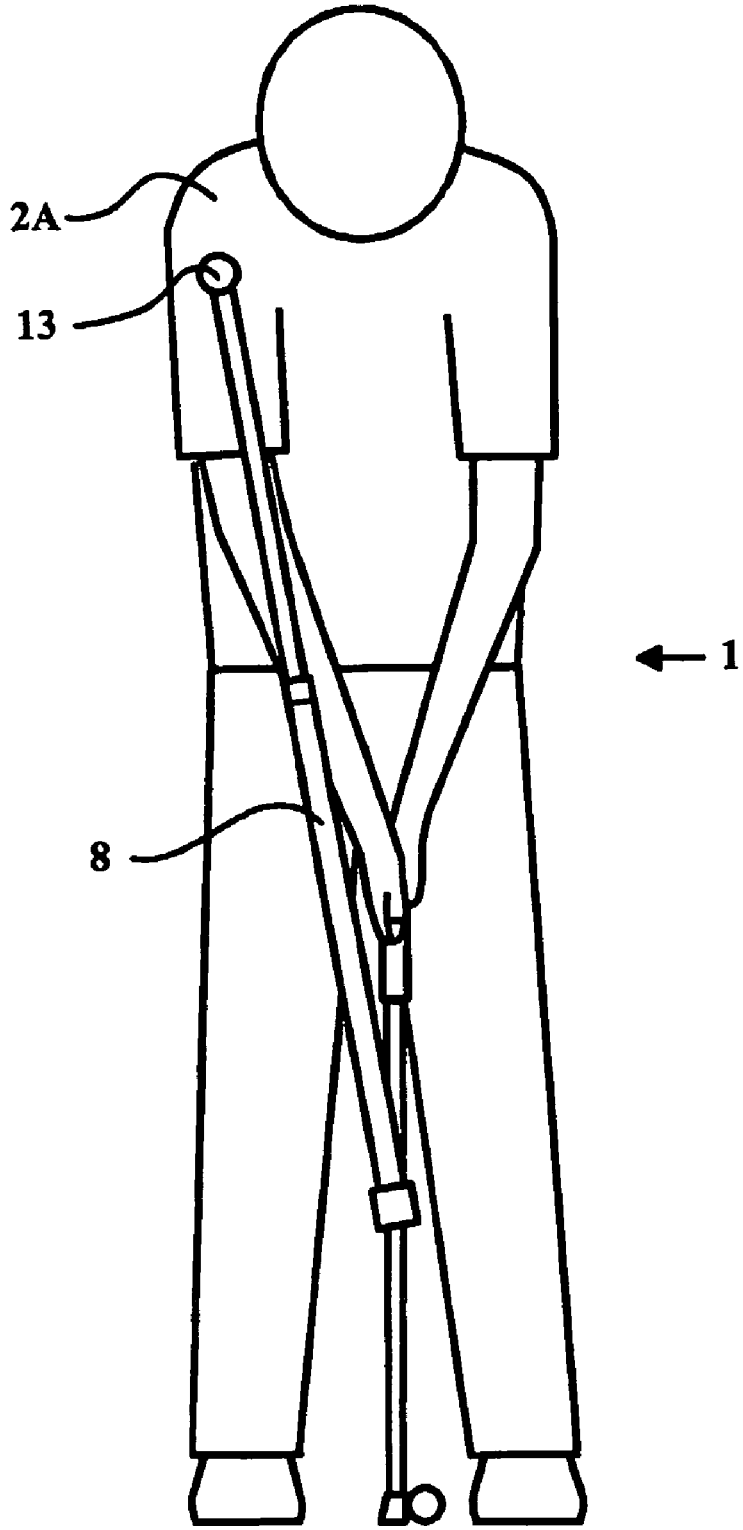
FIG. 5 is a front elevation view, similar to FIG. 1, with the apparatus touching the front of the right shoulder.
Figure 8:
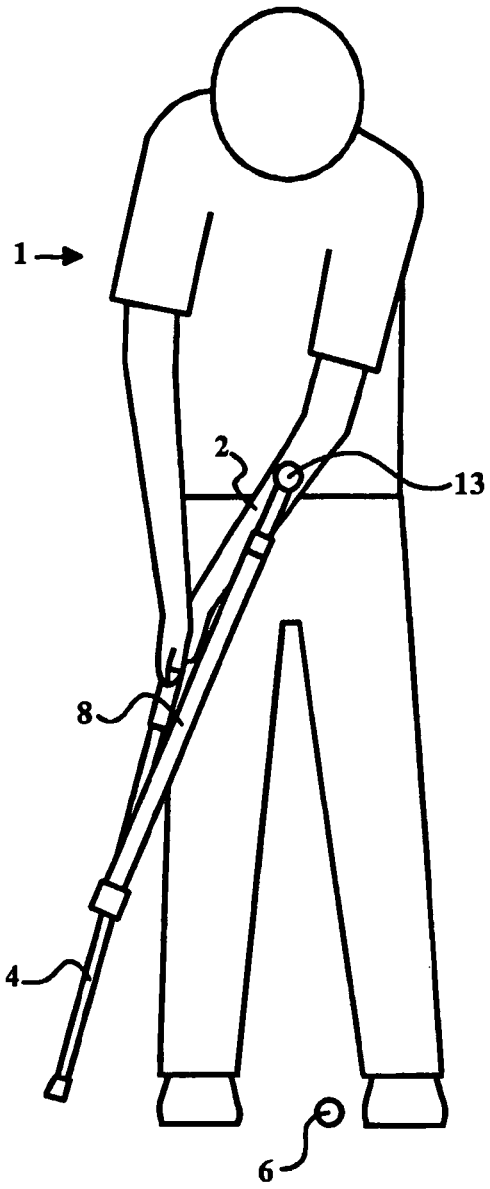
FIG. 8 is a front elevation view of a golfer, using the apparatus, during the backswing or downswing.
Figure 9:
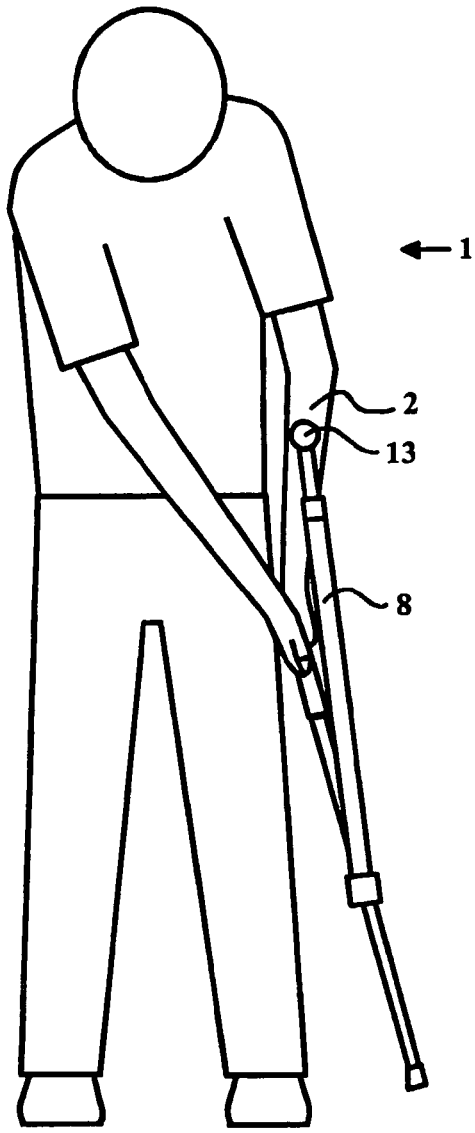

As shown in FIGS. 1-6, the training device can be used to perfect the putting stroke with respect to a large number of parts of the golfer's anatomy. In practice, he/she may first try and improve their technique relative to the left forearm (FIG. 1), then with respect to the right forearm (FIG. 2), then the shoulders (FIGS. 4 and 5), etc. Thus, the training device accommodates a series of stages of training. Often, there is need to return to a previous stage of the training to ensure that particular aspects of the technique have been maintained. FIG. 3 shows another aspect of technique improvement with sphere 13 against the side of left forearm 3. Similarly, FIG. 6 shows another stage of the training. FIGS. 8 and 9 show positions of the putter during the backswing and follow through respectively.

Mounting 10 may be provided with alignment markings, e.g. a simple Vernier-type of scale, so that, once set, a golfer may note the particular readings to enable it to be reset for a subsequent training session. Similarly, telescopic member 12 may have graduated markings. As part of a program of training, the golfer would note the settings for contact with each particular part of the anatomy. This would allow a complete testing program to be worked through and permit a return to any particular stage, if necessary. A mark on putter shaft 4 would show where to attach clamp 9.

Figure 10:
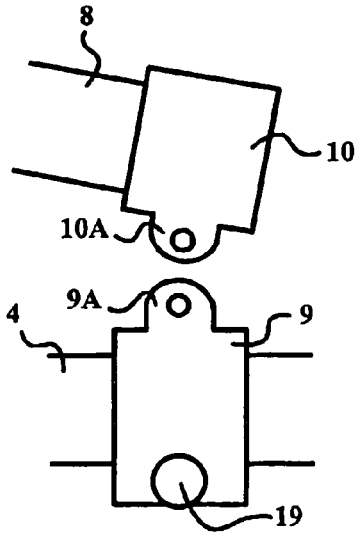
FIG. 10 is an exploded side elevation view of one means of clamping training device 8 to putter shaft 4.
Figure 11:
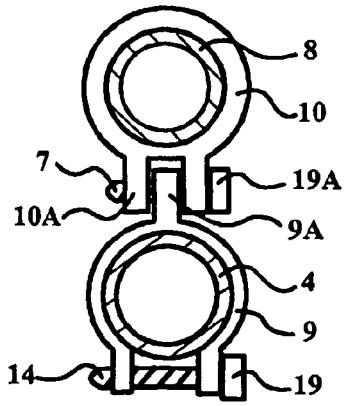
FIG. 11 is a part sectional view of the clamping means shown in FIG. 10.

Another form of adjustable clamp 9,10 is shown in FIGS. 10 and 11. Clamp 9 is a part annular collar having spigots with screw-threaded holes, secured by turning a head 19 of a screw 14 (instead of a screw, a bolt and a hand nut may be used). Clamp 9 is provided on its opposite side with a bored spigot 9A. Clamp 9 is fitted by removing or loosening screw 14, fitting on and sliding up the tapering shaft 4, replacing screw 14 and tightening. Annular collar 10 is fast with tubular member 8 and provided with two bored spigots 10A. Clamp 9 and collar 10 are connected by a screw 7 through spigot 9A and the screw-threaded holes in spigots 10A (again, instead of a screw, a bolt and hand nut may be used). Collar 10 is secured via screw 7 by turning its head 19A.

Clamp 9 may be rotated around putter shaft 4 to the desired angular position prior to securing via screw or bolt 14. This allows device 8 to be angularly aligned with either the left hand side, the right hand side or the center of the body. Further angular adjustment to alter the angle between device 8 and shaft 4 is available via screw or bolt 7. This allows device 8 to be aligned with, for example, the forearm or the shoulder.

These two adjustments, combined with telescopic adjustment 18 of the length of member 12 (or altering the position of mounting 10 on shaft 4), give all the necessary degrees of freedom needed to position sphere 13 against any appropriate part of the golfer's arms, shoulders or upper chest. The screws or bolts 7 and 14 can be tightened and adjusted easily. This allows repeated, minor adjustments to the angles of training device 8 (and to the projecting length of member 12) so that a precise setting of sphere 13 against a chosen part of the golfer's anatomy can be achieved. Precise setting of sphere 13 is needed to gain full value from the putting training technique, as described previously.

Training device 8 would preferably be made of strong, light materials such as metal alloys, so that the additional weight would have a negligible effect on the golfer's putting action whether using device 8, or not. Any mechanism and/or electronics in sphere 13 can be made very light and small. Button batteries of the kind commonly employed in wristwatches would provide adequate electrical power to the electronics, particularly if the operational time was limited, e.g. they flashed or buzzed for only a few seconds, rather than operated continuously, until reset (i.e. brought back into contact with the golfer's body).

Thus, the apparatus of the invention, whether with or without electronic indication, adds A whole new dimension to golf training devices, particularly for putting.

I claim:

1. A training device for use with a putter by a golfer for improving putting technique, the putter having a shaft and a head affixed to a lower end of the shaft, the device comprising:

a linear elongate member having a first end and at least one second end;

a first collar secured to said first end of said elongate member, said first collar having a first bored projecting portion extending therefrom;

a releasable clamping means comprising a partially annular second collar with a first hand-operated screw for tightening and releasing said collar, said clamping means further comprising a second bored projecting portion extending from said second collar and secured to said first bored projecting portion, said elongate member being rotatable relative to said first collar, said clamping means for locking said elongate member in a desired angular position by a second hand-operated screw; and a contacting means for contacting a portion of the body of the golfer, said contacting means comprising a ball attached to said second end of said elongate member, said elongate member extending for a predetermined distance, said first and second hand-operated screws being independently adjustable, said releasable clamping means for detachably connecting said elongate member to the shaft and such that said elongate member extends upwardly away from the shaft at a predetermined angle, said contacting means for contacting the portion of the body of the golfer such that said contacting means remains in contact with the portion of the body when the golfer executes a desired putting stroke and such that said contacting means is out of the position of contact with the body when the golfer executes a non-desired putting stroke.

2. The training device of claim 1, said ball being formed of a resilient material.

3. The training device of claim 1, said elongate member being telescopic.

4. The training device of claim 1, said elongate member being a tube having a single second end.

5. The training device of claim 1, said elongate member being a rod having a single second end.

6. The training device of claim 1, said elongate member having a pair of second ends, said contacting means attached to each of said pair of second ends.

7. The training device of claim 1, said ball being removably affixed to said second end of said elongate member.

* * * * *